US008699923B2

(12) United States Patent
Nishiwaki

(10) Patent No.: US 8,699,923 B2
(45) Date of Patent: Apr. 15, 2014

(54) DEVELOPMENT AGENT SUPPLY DEVICE HAVING A TRANSFER BOARD FOR TRANSFERRING DEVELOPMENT AGENT AND IMAGE FORMING APPARATUS HAVING THE SAME

(75) Inventor: Kenjiro Nishiwaki, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 424 days.

(21) Appl. No.: 12/894,879

(22) Filed: Sep. 30, 2010

(65) Prior Publication Data

US 2011/0103849 A1 May 5, 2011

(30) Foreign Application Priority Data

Oct. 30, 2009 (JP) ..... 2009-249798

(51) Int. Cl.
*G03G 15/08* (2006.01)

(52) U.S. Cl.
USPC ..... 399/266; 399/289

(58) Field of Classification Search
USPC ..... 399/266, 289, 291, 281, 283, 285, 265, 399/53, 55
See application file for complete search history.

(56) References Cited

U.S. PATENT DOCUMENTS

| | | | | |
|---|---|---|---|---|
| 5,142,336 | A | 8/1992 | Hotomi et al. | |
| 6,272,296 | B1 | 8/2001 | Gartstein | |
| 6,901,231 | B1 | 5/2005 | Sakai et al. | |
| 8,095,052 | B2 | 1/2012 | Nishiwaki et al. | |
| 8,311,462 | B2 | 11/2012 | Okamura | |
| 8,326,188 | B2 | 12/2012 | Nishiwaki | |
| 2004/0213608 | A1* | 10/2004 | Sakuma et al. | 399/388 |
| 2008/0013990 | A1 | 1/2008 | Samweber | |
| 2009/0136269 | A1* | 5/2009 | Aratachi | 399/289 |

(Continued)

FOREIGN PATENT DOCUMENTS

| | | | |
|---|---|---|---|
| JP | HEI 3-012678 | A | 1/1991 |
| JP | HEI 11-084862 | A | 3/1999 |

(Continued)

OTHER PUBLICATIONS

Notification of Reasons for Rejection dated Sep. 13, 2011 received from the Japanese Patent Office from related Japanese Application No. 2009-249798, together with an English-language translation.

(Continued)

*Primary Examiner* — Billy Lactaoen
(74) *Attorney, Agent, or Firm* — Scully, Scott, Murphy & Presser, P.C.

(57) ABSTRACT

A development agent supply device has a transfer board including a supply section disposed upstream relative to a proximity position in a development agent transfer direction, and a retrieving section disposed downstream relative to the proximity position in the development agent transfer direction. The supply section includes first transfer electrodes arranged along the development agent transfer direction to transfer development agent toward the proximity position with an electric field generated with a supply bias applied to the first transfer electrodes and supply the development agent to the development agent holding surface near the proximity position. The retrieving section includes second transfer electrodes arranged along the development agent transfer direction to retrieve development agent from the development agent holding surface near the proximity position and transfer the development agent downstream in the development agent transfer direction with an electric field generated with a retrieving bias applied to the second transfer electrodes.

6 Claims, 4 Drawing Sheets

(56) References Cited

U.S. PATENT DOCUMENTS

| | | | |
|---|---|---|---|
| 2009/0175662 | A1 | 7/2009 | Nishiwaki |
| 2009/0232562 | A1 | 9/2009 | Hazeyama |
| 2009/0238611 | A1 | 9/2009 | Hazeyama |
| 2009/0297228 | A1 | 12/2009 | Maeda et al. |
| 2011/0236078 | A1 | 9/2011 | Takahashi et al. |
| 2011/0293335 | A1 | 12/2011 | Takahashi et al. |
| 2012/0027471 | A1 | 2/2012 | Nishigaki et al. |
| 2012/0201576 | A1 | 8/2012 | Uno et al. |

FOREIGN PATENT DOCUMENTS

| | | | |
|---|---|---|---|
| JP | 2001-209246 | | 8/2001 |
| JP | 2002-116620 | | 4/2002 |
| JP | 2002-287495 | | 10/2002 |
| JP | 2003-280388 | | 10/2003 |
| JP | 2004-198675 | | 7/2004 |
| JP | 2006-047654 | | 2/2006 |
| JP | 2006047654 | A * | 2/2006 |
| JP | 2008-070803 | A | 3/2008 |
| JP | 2008-83237 | | 4/2008 |
| JP | 2008-523429 | A | 7/2008 |
| JP | 2009-229674 | A | 10/2009 |

OTHER PUBLICATIONS

Notice of Allowance dated Aug. 8, 2013 in U.S. Appl. No. 13/072,473.

Official Action dated Apr. 17, 2013 from related U.S. Appl. No. 13/072,473.

* cited by examiner z

DEVELOPMENT AGENT SUPPLY DEVICE HAVING A TRANSFER BOARD FOR TRANSFERRING DEVELOPMENT AGENT AND IMAGE FORMING APPARATUS HAVING THE SAME

CROSS-REFERENCE TO RELATED APPLICATION

This application claims priority under 35 U.S.C. §119 from Japanese Patent Application No. 2009-249798 filed on Oct. 30, 2009. The entire subject matter of the application is incorporated herein by reference.

BACKGROUND

1. Technical Field

The following description relates to one or more development agent supply devices.

2. Related Art

A development agent supply device has been known that includes a plurality of transfer electrodes disposed along a development agent transfer path. The known development agent supply device is configured to convey development agent with an electric field generated by a driving voltage applied to the transfer electrodes.

SUMMARY

There are some requirements for a development agent supply device of this kind, such as transferring and supplying development agent in a more preferable fashion and downsizing the development agent supply device.

Aspects of the present invention are advantageous to provide one or more improved configurations for a development agent supply device that make it possible to transfer and supply development agent in a more preferable fashion and downsize the development agent supply device.

According to aspects of the present invention, a development agent supply device is provided that is configured to supply charged development agent to an intended device. The development agent supply device includes a development agent holding member that includes a development agent holding surface that is formed to be a cylindrical circumferential surface parallel to a predetermined direction and disposed to face the intended device in a development agent supply position, the development agent holding member being configured to rotate around an axis parallel to the predetermined direction such that the development agent holding surface moves in a direction perpendicular to the predetermined direction, and a transfer board that includes a development agent transfer surface configured to face the development agent holding surface in a proximity position where the development agent transfer surface is in closest proximity to the development agent holding surface, the transfer board being configured to transfer development agent on the development agent transfer surface in a development agent transfer direction perpendicular to the predetermined direction, a supply section disposed upstream relative to the proximity position in the development agent transfer direction, and a retrieving section disposed downstream relative to the proximity position in the development agent transfer direction. The supply section includes a plurality of first transfer electrodes arranged along the development agent transfer direction, the supply section being configured to transfer the development agent toward the proximity position in the development agent transfer direction on the development agent transfer surface and supply the development agent to the development agent holding surface near the proximity position, with an electric field generated when a supply bias is applied to the first transfer electrodes, the supply bias containing a first direct-current voltage component and a first traveling-wave multiple-phase alternating-current voltage component. The retrieving section includes a plurality of second transfer electrodes arranged along the development agent transfer direction, the retrieving section being configured to retrieve development agent from the development agent holding surface near the proximity position and transfer the development agent downstream in the development agent transfer direction on the development agent transfer surface, with an electric field generated when a retrieving bias is applied to the second transfer electrodes, the retrieving bias containing a second direct-current voltage component different from the first direct-current voltage component and a second traveling-wave multiple-phase alternating-current voltage component.

According to aspects of the present invention, further provided is a development agent supply device configured to supply charged development agent to a development agent holding surface that moves in a direction perpendicular to a predetermined direction. The development agent supplying device includes a transfer board that includes a development agent transfer surface configured to face the development agent holding surface in a proximity position where the development agent transfer surface is in closest proximity to the development agent holding surface, the transfer board being configured to transfer development agent on the development agent transfer surface in a development agent transfer direction perpendicular to the predetermined direction, a supply section disposed upstream relative to the proximity position in the development agent transfer direction, and a retrieving section disposed downstream relative to the proximity position in the development agent transfer direction. The supply section includes a plurality of first transfer electrodes arranged along the development agent transfer direction, the supply section being configured to transfer the development agent toward the proximity position in the development agent transfer direction on the development agent transfer surface and supply the development agent to the development agent holding surface near the proximity position, with an electric field generated when a supply bias is applied to the first transfer electrodes, the supply bias containing a first direct-current voltage component and a first traveling-wave multiple-phase alternating-current voltage component. The retrieving section includes a plurality of second transfer electrodes arranged along the development agent transfer direction, the retrieving section being configured to retrieve development agent from the development agent holding surface near the proximity position and transfer the development agent downstream in the development agent transfer direction on the development agent transfer surface, with an electric field generated when a retrieving bias is applied to the second transfer electrodes, the retrieving bias containing a second direct-current voltage component different from the first direct-current voltage component and a second traveling-wave multiple-phase alternating-current voltage component.

According to aspects of the present invention, further provided is an image forming apparatus including a photoconductive body configured such that a development agent image is formed thereon, and a development agent supply device configured to supply charged development agent to the photoconductive body. The development agent supply device includes a development agent holding member that has a development agent holding surface that is formed to be a cylindrical circumferential surface parallel to a predetermined direction and disposed to face the photoconductive drum in a development agent supply position, the development agent holding member being configured to rotate around an axis parallel to the predetermined direction such that the development agent holding surface moves in a direction perpendicular to the predetermined direction, and a transfer board that has a development agent transfer surface configured to face the development agent holding surface in a proximity position where the development agent transfer surface is in closest proximity to the development agent holding surface, the transfer board being configured to transfer development agent on the development agent transfer surface in a development agent transfer direction perpendicular to the predetermined direction, a supply section disposed upstream relative to the proximity position in the development agent transfer direction, and a retrieving section disposed downstream relative to the proximity position in the development agent transfer direction. The supply section includes a plurality of first transfer electrodes arranged along the development agent transfer direction, the supply section being configured to transfer the development agent toward the proximity position in the development agent transfer direction on the development agent transfer surface and supply the development agent to the development agent holding surface near the proximity position, with an electric field generated when a supply bias is applied to the first transfer electrodes, the supply bias containing a first direct-current voltage component and a first traveling-wave multiple-phase alternating-current voltage component. The retrieving section includes a plurality of second transfer electrodes arranged along the development agent transfer direction, the retrieving section being configured to retrieve development agent from the development agent holding surface near the proximity position and transfer the development agent downstream in the development agent transfer direction on the development agent transfer surface, with an electric field generated when a retrieving bias is applied to the second transfer electrodes, the retrieving bias containing a second direct-current voltage component different from the first direct-current voltage component and a second traveling-wave multiple-phase alternating-current voltage component.

BRIEF DESCRIPTION OF THE ACCOMPANYING DRAWINGS

Figure 4:
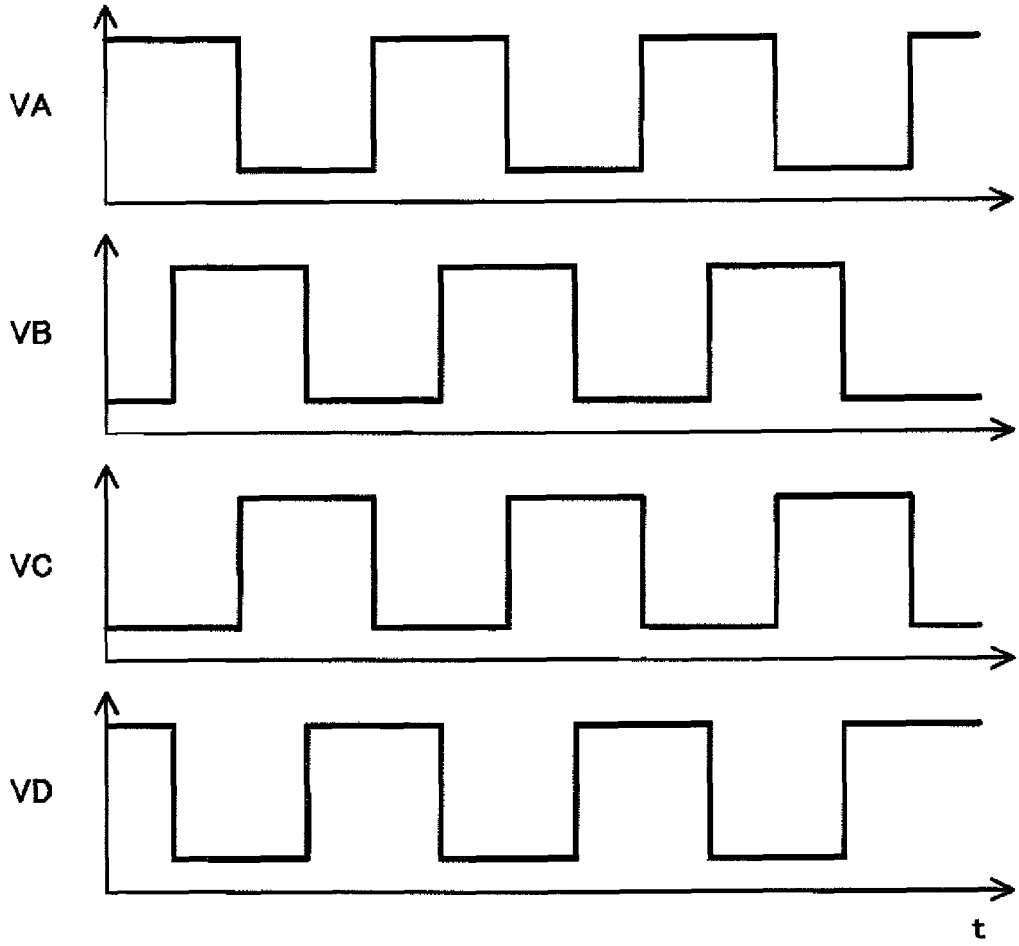

FIG. 4 exemplifies waveforms of voltages generated by power supply circuits for the transfer board in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

<Configuration of Laser Printer>

Figure 1:
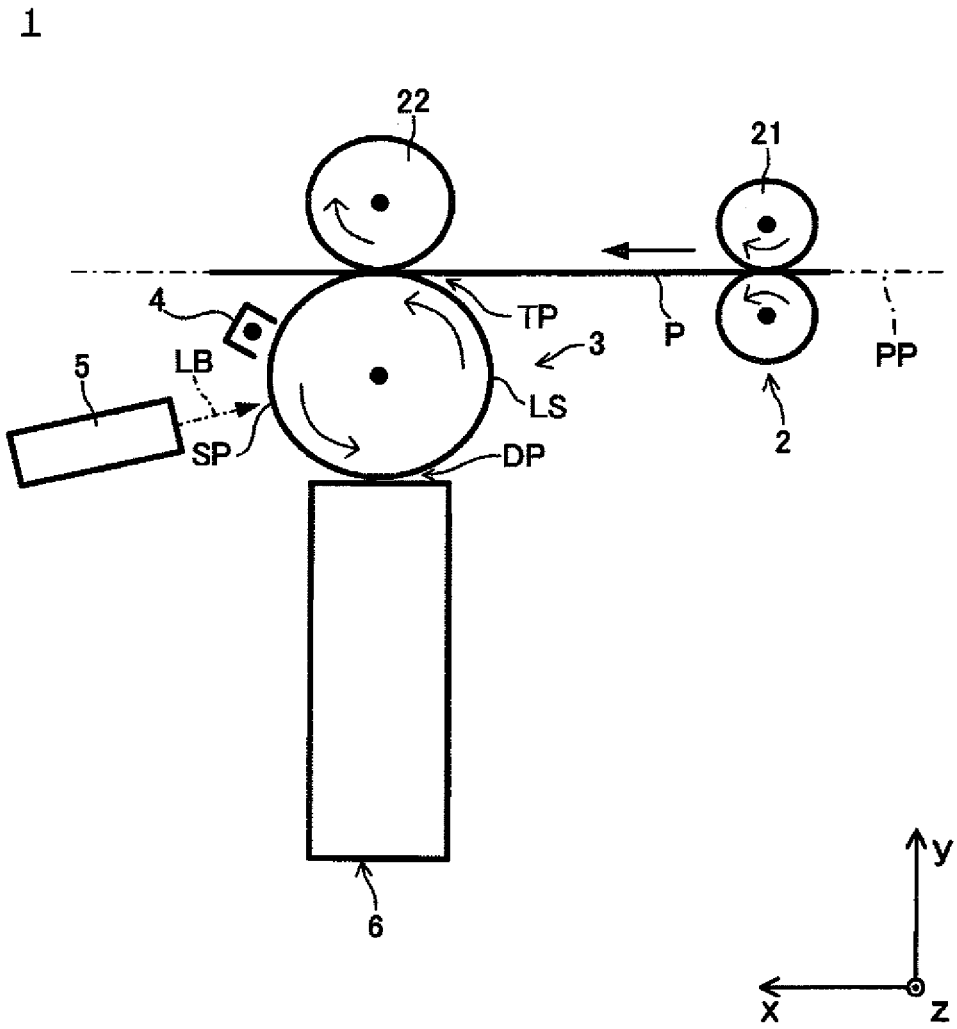
FIG. 1 is a side view schematically showing a configuration of a laser printer in an embodiment according to one or more aspects of the present invention.

As illustrated in FIG. 1, a laser printer 1 includes a sheet feeding mechanism 2, a photoconductive drum 3, an electrification device 4, a scanning unit 5, and a toner supply device 6. A feed tray (not shown), provided in the laser printer 1, is configured such that a stack of sheets P is placed thereon. The sheet feeding mechanism 2 is configured to feed a sheet P along a predetermined sheet feeding path PP.

On a circumferential surface of the photoconductive drum 3, an electrostatic latent image holding surface LS is formed as a cylindrical surface parallel to a main scanning direction (i.e., a z-axis direction in FIG. 1). The electrostatic latent image holding surface LS is configured such that an electrostatic latent image is formed thereon in accordance with an electric potential distribution. Further, the electrostatic latent image holding surface LS is configured to hold toner T (see FIG. 2) in positions corresponding to the electrostatic latent image. The photoconductive drum 3 is driven to rotate in the direction indicated by arrows (counterclockwise) in FIG. 1 around a center axis C that is parallel to the main scanning direction. Thus, the photoconductive drum 3 is configured to move the electrostatic latent image holding surface LS along an auxiliary scanning direction perpendicular to the main scanning direction.

The electrification device 4 is disposed to face the electrostatic latent image holding surface LS. The electrification device 4, which is of a corotron type or a scorotron type, is configured to evenly and positively charge the electrostatic latent image holding surface LS.

The scanning unit 5 is configured to generate a laser beam LB modulated based on image data. Specifically, the scanning unit 5 is configured to generate the laser beam LB within a predetermined wavelength range, which laser beam LB is emitted under ON/OFF control depending on whether there is a pixel in a target location on the image data. In addition, the scanning unit 5 is configured to converge the laser beam LB in a scanned position SP on the electrostatic latent image holding surface LS. Here, the scan position SP is set in a position downstream relative to the electrification device 4 in the rotational direction of the photoconductive drum 3 (i.e., the counterclockwise direction indicated by the arrows in FIG. 1). Further, the scanning unit 5 is configured to form the electrostatic latent image on the electrostatic latent image holding surface LS while moving a position, in which the laser beam LB is converged on the electrostatic latent image holding surface LS, along the main scanning direction at a constant speed.

The toner supply device 6 is disposed under the photoconductive body 3 so as to face the photoconductive body 3. The toner supply device 6 is configured to supply the charged toner T (see FIG. 2), in a development position DP, onto the photoconductive drum 3 (the electrostatic latent image holding surface LS). It is noted that the development position DP denotes a position where the toner supply device 6 faces the electrostatic latent image holding surface LS. A detailed explanation will be provided later about the configuration of the toner supply device 6.

Subsequently, a detailed explanation will be provided about a specific configuration of each element included in the laser printer 1.

The sheet feeding mechanism 2 includes a pair of registration rollers 21, and a transfer roller 22. The registration rollers 21 are configured to feed a sheet P toward between the photoconductive drum 3 and the transfer roller 22 at a predetermined moment. The transfer roller 22 is disposed to face the electrostatic latent image holding surface LS (i.e., the outer circumferential surface of the photoconductive drum 3) across the sheet P in a transfer position TP. Additionally, the transfer roller 22 is driven to rotate in a clockwise direction indicated by an arrow in FIG. 1. The transfer roller 22 is connected to a bias power supply circuit (not shown). Specifically, the transfer roller 22 is configured such that a predetermined transfer bias voltage is applied between the transfer roller 22 and the photoconductive drum 3 so as to transfer, onto the sheet P, the toner T (see FIG. 2) which adheres onto the electrostatic latent image holding surface LS.

<<Toner Supply Device>>

Figure 2:
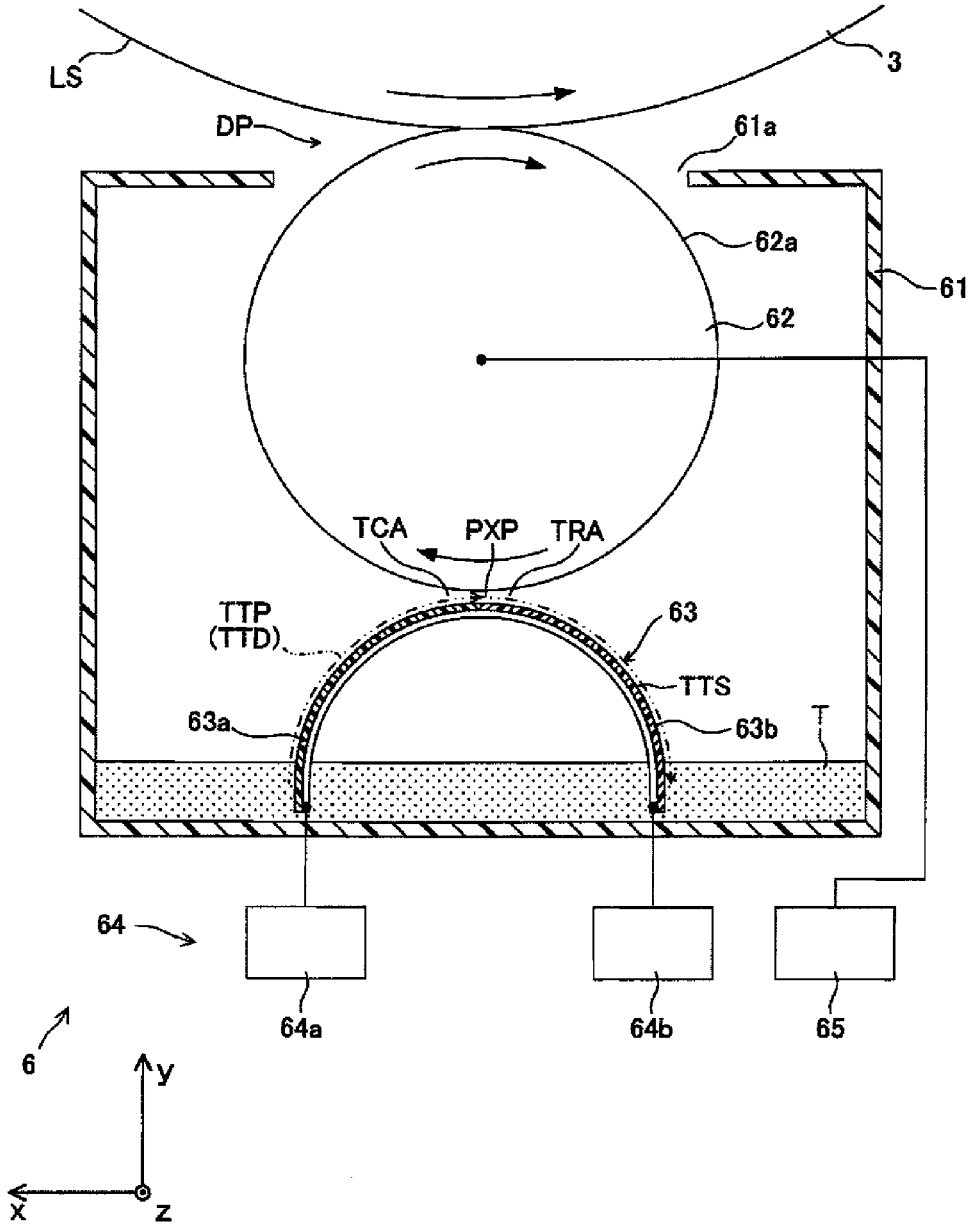
FIG. 2 is an enlarged cross-sectional side view of a toner supply device included in the laser printer in the embodiment according to one or more aspects of the present invention.

As depicted in FIG. 2 that is a cross-sectional side view (a cross-sectional view along a plane with the main scanning direction as a normal line) of the toner supply device 6, a toner box 61 is formed as a box-shaped casing of the toner supply device 6, and configured to accommodate the toner T (powdered dry-type development agent). In the embodiment, the toner T is positively-chargeable nonmagnetic-one-component black toner. Further, the toner box 61 has an opening 61*a* formed in such a position at a top of the toner box 61 as to face the photoconductive drum 3. In other words, the opening 61*a* is opened up toward the photoconductive drum 3.

The development roller 62 is a roller-shaped member having a toner holding surface 62*a* that is a cylindrical circumferential surface parallel to the main scanning direction. The development roller 62 is disposed beneath the photoconductive drum 3. The development roller 62 is housed in the toner box 61 such that the toner holding surface 62*a* is exposed outside the toner box 61 via the opening 61*a* so as to face the electrostatic latent image holding surface LS. In other words, the development roller 62 is disposed such that a top of the toner holding surface 62*a* and the electrostatic latent image holding surface LS of the photoconductive drum 3 face each other in the development position DP in closest proximity to or contact with each other.

The development roller 62 is supported near the opening 61*a* of the toner box 61 in a manner rotatable around an axis parallel to the main scanning direction. Namely, the development roller 62 is configured to, when rotating in a clockwise direction indicated by arrows in FIG. 2 around the axis parallel to the main scanning direction, move the toner holding surface 62*a* in the auxiliary scanning direction.

A transfer board 63 is disposed under the development roller 62 inside the toner box 61. The transfer board 63 is formed in the shape of a half cylinder that protrudes upward when viewed in the z-axis direction (i.e., the main scanning direction) in FIG. 2. The transfer board 63 has a toner transfer surface TTS that is an outer (upper) surface of the transfer board 63. The transfer board 63 is disposed such that a top of the toner transfer surface TTS and the toner holding surface 62*a* of the development roller 62 face each other in closest proximity to each other in a proximity position PXP.

The transfer board 63 is configured to transfer the toner T with electric fields, on the toner transfer surface TTS, in a toner transfer direction TTD along a toner transfer path TTP perpendicular to the main scanning direction. The toner transfer path TTP is a transfer path along the toner transfer surface TTS, on which the toner T is transferred by the electric fields. Further, the toner transfer path TTP is formed substantially in the shape of a half circle that protrudes upward when viewed in the z-axis direction (i.e., the main scanning direction) in FIG. 2. In addition, the toner transfer direction TTD is a tangential direction in any point on the toner transfer path TTP when viewed in the z-axis direction (i.e., the main scanning direction) in FIG. 2. In the embodiment, the transfer board 63 is configured such that the toner transfer direction TTD (a right or clockwise direction indicated by a two-dot chain line in FIG. 2) is opposite to a moving direction (see a left-pointing arrow in FIG. 2) of the toner holding surface 62*a* in the proximity position PXP.

The transfer board 63 includes a supply section 63*a* provided upstream relative to the proximity position PXP in the toner transfer direction TTD, and a retrieving section 63*b* provided downstream relative to the proximity position PXP in the toner transfer direction TTD. An upstream end of the supply section 63*a* in the toner transfer direction TTD and a downstream end of the retrieving section 63*b* in the toner transfer direction TTD are immersed in the toner T stored in a bottom region in an internal space of the toner box 61.

The supply section 63*a* is configured to supply the toner T to the toner holding surface 62*a* in a toner carrying area TCA, which is close to the proximity position PXP and at an upstream side in the toner transfer direction TTD, by conveying the toner T to the proximity position PXP. The retrieving section 63*b* is configured to retrieve the toner T from the toner holding surface 62*a* in a toner retrieving area TRA, which is close to the proximity position PXP and at a downstream side in the toner transfer direction TTD, and to convey the toner T to a downstream side in the toner transfer direction TTD. Further, the retrieving section 63*b* is configured to convey the toner T that has not been transferred onto the toner holding surface 62*a* in the toner carrying area TCA from the proximity position PXP to the downstream side in the toner transfer direction TTD. It is noted that a detailed explanation will be provided later about an internal configuration of the transfer board 63 (the supply section 63*a* and the retrieving section 63*b*).

The transfer board 63 is electrically connected with a transfer power supply circuit 64. The transfer power supply circuit 64 includes a supply bias power supply circuit 64*a* and a retrieving bias power supply circuit 64*b*. The supply bias power supply circuit 64*a* is electrically connected with the supply section 63*a*. The retrieving bias power supply circuit 64*b* is electrically connected with the retrieving section 63*b*. Additionally, the development roller 62 is electrically connected with a development bias power supply circuit 65.

The transfer power supply circuit 64 and the development bias power supply circuit 65 are configured to generate voltages required for transferring the toner T along the toner transfer path TTP in the toner transfer direction TTD, making the toner holding surface 62*a* carry the toner T in the toner carrying area TCA, and retrieving the toner T from the toner holding surface 62*a* in the toner retrieving area TRA.

Specifically, in the embodiment, the supply bias power supply circuit 64*a* is configured to generate a supply bias of 600 V to 1200 V (the direct-current voltage: +900 V, the amplitude of the multiple-phase alternating-current voltage: 300 V). In addition, the retrieving bias power supply circuit 64*b* is configured to generate a retrieving bias of 0 V to 600 V (the direct-current voltage: +300 V, the amplitude of the multiple-phase alternating-current voltage: 300 V). Further, the development bias power supply circuit 65 is configured to generate a development bias with a direct-current voltage of +600 V. Namely, the development bias power supply circuit 65 is adapted to set an average electric potential of the toner holding surface 62*a* (i.e., an average value of the development bias) to a value between an average value of the supply bias and an average value of the retrieving bias. In addition, the retrieving bias contains a traveling-wave multiple-phase alternating-current voltage component with the same amplitude as that of the supply bias and a direct-current voltage component different from that of the supply bias.

<<<Transfer Board>>>

Figure 3:
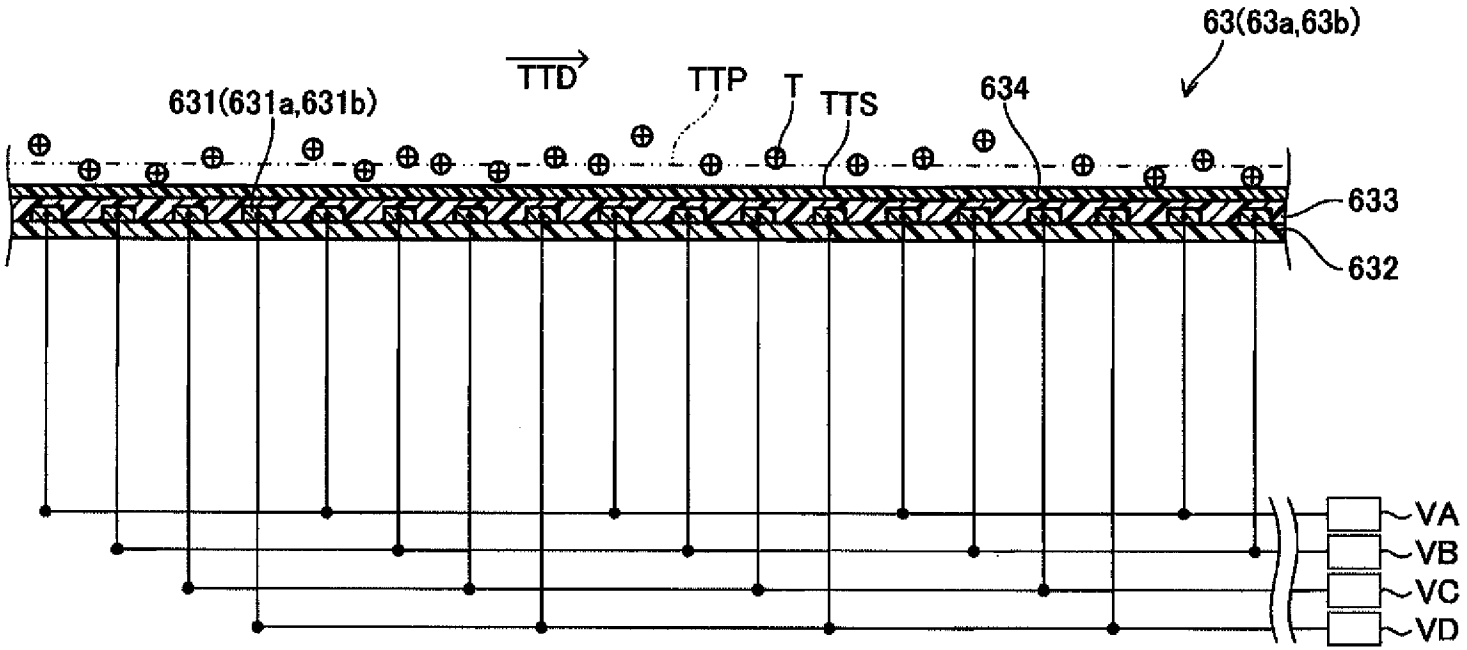
FIG. 3 is an enlarged cross-sectional side view of a transfer board included in the toner supply device in the embodiment according to one or more aspects of the present invention.

Referring to FIG. 3, the transfer board 63 is a thin plate member configured in the same manner as a flexible printed-circuit board. Specifically, the transfer board 63 includes a plurality of transfer electrodes 631, a transfer electrode supporting film 632, a transfer electrode coating layer 633, and a transfer electrode overcoating layer 634.

The transfer electrodes 631 include transfer electrodes 631*a* for toner supply that are disposed at the supply section 63*a*, and transfer electrodes 631*b* for toner retrieving that are disposed at the retrieving section 63*b*. The transfer electrodes 631 are linear wiring patterns elongated in a direction parallel to the main scanning direction (i.e., in a direction perpendicular to the auxiliary scanning direction). The transfer electrodes 631 are formed with copper thin films. The transfer electrodes 631 are arranged along the toner transfer path TTP so as to be parallel to each other.

Every four ones of the transfer electrodes 631, arranged along the toner transfer path TTP, are connected in common with a specific one of four power supply circuits VA, VB, VC, and VD. In other words, the transfer electrodes 631 are arranged along the toner transfer path TTP in the following order: a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, . . . .

It is noted that the power supply circuits VA, VB, VC, and VD are included in each of the supply bias power supply circuit 64*a* and the retrieving bias power supply circuit 64*b* shown in FIG. 2. Specifically, referring to FIGS. 2 and 3, the supply bias power supply circuit 64*a* is configured to apply the supply bias to the transfer electrodes 631*a* for toner supply. Further, the retrieving bias power supply circuit 64*b* is configured to apply, to the transfer electrodes 631*b* for toner retrieving, the retrieving bias that contains the traveling-wave multiple-phase alternating-current voltage component in synchronization with the supply bias.

FIG. 4 exemplifies output waveforms, which are respectively generated by the power supply circuits VA, VB, VC, and VD shown in FIG. 3. In the embodiment, as illustrated in FIG. 4, the power supply circuits VA, VB, VC, and VD are configured to generate respective alternating-current driving voltages of substantially the same waveform. Further, the power supply circuits VA, VB, VC, and VD are configured to generate the respective alternating-current driving voltages with a phase difference of 90 degrees between any adjacent two of the power supply circuits VA, VB, VC, and VD in the aforementioned order. In other words, the power supply circuits VA, VB, VC, and VD are configured to output the respective alternating-current driving voltages each of which is delayed by a phase of 90 degrees behind the voltage output from a precedent adjacent one of the power supply circuits VA, VB, VC, and VD in the aforementioned order. Thus, the transfer board 63 is configured to transfer the positively charged toner T in the toner transfer direction TTD when the aforementioned diving voltages are applied to the transfer electrodes 631.

The transfer electrodes 631 are formed on a surface of the transfer electrode supporting film 632. The transfer electrode supporting film 632 is a flexible film made of electrically insulated synthetic resin such as polyimide resin. The transfer electrode coating layer 633 is made of electrically insulated synthetic resin. The transfer electrode coating layer 633 is provided to coat the transfer electrodes 631 and a surface of the transfer electrode supporting film 632 on which the transfer electrodes 631 are formed. On the transfer electrode coating layer 633, the transfer electrode overcoating layer 634 is provided. Namely, the transfer electrode coating layer 633 is formed between the transfer electrode overcoating layer 634 and the transfer electrodes 631. The surface of the transfer electrode overcoating layer 634 is formed as a smooth surface with a very low level of irregularity, so as to smoothly convey the toner T.

<Operations of Laser Printer>

Subsequently, a general overview will be provided of operations of the laser printer configured as above with reference to the relevant drawings.

<<Sheet Feeding Operation>>

Referring to FIG. 1, firstly, a leading end of a sheet P placed on the feed tray (not shown) is conveyed to the registration rollers 21. The registration rollers perform skew correction for the sheet P, and adjust a moment when the sheet P be fed forward. After that, the sheet P is fed to the transfer position TP.

<<Formation of Toner Image on Electrostatic Latent Image Holding Surface>>

While the sheet P is being conveyed to the transfer position TP as described above, an image of the toner T (i.e., a toner image) is formed on the electrostatic latent image holding surface LS that is the outer circumferential surface of the photoconductive drum 3, as will be mentioned below.

<<Formation of Electrostatic Latent Image>>

Firstly, the electrostatic latent image holding surface LS of the photoconductive drum 3 is charged evenly and positively by the electrification device 4. The electrostatic latent image holding surface LS, charged by the electrification device 4, is moved along the auxiliary scanning direction to the scanned position SP to face the scanning unit 5, when the photoconductive drum 3 rotates in the counterclockwise direction shown by an arrow in FIG. 2.

In the scanned position SP, the electrostatic latent image holding surface LS is exposed to the laser beam LB that is modulated based on the image data. Namely, while being scanned along the main scanning direction, the laser beam LB is rendered incident onto the electrostatic latent image holding surface LS. In accordance with the modulation of the laser beam LB, areas with no positive charge are generated on the electrostatic latent image holding surface LS. Thereby, an electrostatic latent image is formed with a positive charge pattern (positive charges distributed in the shape of an image) on the electrostatic latent image holding surface LS. The electrostatic latent image, formed on the electrostatic latent image holding surface LS, is transferred to the development position DP to face the toner supply device 6 when the photoconductive drum 3 rotates in the counterclockwise direction shown by the arrow in FIG. 2.

<<Transfer and Supply of Charged Toner>>

Referring to FIGS. 2 and 3, the toner T stored in the toner box 61 is charged due to contact or friction with the transfer electrode overcoating layer 634, around the upstream end of the supply section 63*a* in the toner transfer direction TTD. The charged toner T is conveyed to the proximity position PXP in the toner transfer direction TTD, by an electric field generated when the supply bias is applied to the transfer electrodes 631*a* for toner supply of the supply section 63*a*.

When reaching the toner carrying area TCA, a part of the toner T being conveyed in the toner transfer direction TTD by the supply section 63*a* is transferred onto the toner holding surface 62*a* and held on the toner holding surface 62*a*. Toner T, which stays without being transferred onto the toner holding surface 62*a*, reaches the upstream end of the retrieving section 63*b* in the toner transfer direction TTD after passing through the toner carrying area TCA and the proximity position PXP.

The toner holding surface 62*a*, which holds the positively charged toner T transferred thereto in the toner carrying area TCA, is moved to the development position DP when the development roller 62 is driven to rotate in the clockwise direction indicated by the arrows in FIG. 2. Thereby, the toner T is supplied to the development position DP. Near the development position DP, the electrostatic latent image, formed on the electrostatic latent image holding surface LS, is developed with the toner T. Namely, the toner T is transferred to adhere onto the areas on the electrostatic latent image holding surface LS where positive charges are vanished. Thereby, the image of the toner T (hereinafter referred to as a "toner image") is carried on the electrostatic latent image holding surface LS.

On the toner holding surface 62*a* after passing through the development position DP, there is toner T remaining without being used for the development in the development position DP, as a negative image (a reversed image) of the toner image formed on the electrostatic latent image holding surface LS. The remaining toner T is transferred to the toner retrieving area TRA when the development roller 62 is driven to rotate in the clockwise direction indicated by the arrows in FIG. 2. In the toner retrieving area TRA, the toner T remaining on the toner holding surface 62*a* is transferred to the retrieving section 63*b* (i.e., the remaining toner T is retrieved by the retrieving section 63*b*).

The toner holding surface 62*a*, from which the remaining toner T is retrieved (removed) through the toner retrieving area TRA in a preferable manner, again reaches the toner carrying area TCA along with the rotation of the development in the clockwise direction indicated by the arrows in FIG. 2, and newly holds toner T. Therefore, in the embodiment, since the toner holding surface 62*a*, on which the toner T remains as a negative image, again reaches the toner carrying area TCA and again holds toner T, it is possible to prevent generation of a ghost on a subsequently formed image in a preferable manner.

A part, of the toner T conveyed to the toner carrying area TCA by the supply section 63*a*, which part has not been transferred onto the toner holding surface 62*a*, and the toner T retrieved from the toner holding surface 62*a* in the toner retrieving area TRA are conveyed from the toner retrieving area TRA in the toner transfer direction TTS, by an electric field generated when the retrieving bias is applied to the transfer electrodes 631*b* for toner retrieving of the retrieving section 63*b*. Then, the above non-transferred toner T and retrieved toner T are returned into the bottom region of the toner box 61 where the toner T is stored.

<<Transfer of Toner Image from Electrostatic Latent Image Holding Surface onto Sheet>>

Referring to FIG. 1, the toner image, which is held on the electrostatic latent image holding surface LS of the photoconductive drum 3 as described above, is conveyed to the transfer position TP when the electrostatic latent image holding surface LS turns in the counterclockwise direction shown by the arrows in FIG. 1. Then, in the transfer position TP, the toner image is transferred from the electrostatic latent image holding surface LS onto the sheet P.

<Effects>

In the embodiment, the supply section 63*a* for supplying the toner T to the toner holding surface 62*a* is configured with an upstream portion of the transfer board 63 relative to the proximity position PXP in the toner transfer direction TTD. Further, the retrieving section 63*b* for retrieving the toner T from the toner holding surface 62*a* is configured with a downstream portion of the transfer board 63 relative to the proximity position PXP in the toner transfer direction TTD. Namely, the supply section 63*a* and the retrieving section 63*b* are integrated as the transfer board 63. Thereby, it is possible to lessen the manufacturing cost of the laser printer 1 and downsize the laser printer 1.

Additionally, in the embodiment, the supply section 63*a* and the retrieving section 63*b*, which are integrated as the transfer board 63, transfers the toner T in the same direction. Hence, it is possible to prevent the toner T from staying near the proximity position PXP, in a preferable manner. In other words, the toner T is smoothly transferred on the toner transfer surface TTS along the toner transfer path TTP, by the electric fields.

Further, in the embodiment, in the proximity position PXP, the moving direction of the toner holding surface 62*a* is opposite to the toner transfer direction TTD. In this situation, the toner holding surface 62*a*, on which the toner T remains as a negative image after the toner holding surface 62*a* passes through the development position DP, firstly faces the retrieving section 63*b* in the toner retrieving area TRA, and thereafter faces the supply section 63*a* in the toner carrying area TCA. In addition, the average electric potential of the toner holding surface 62*a* is set to a value between the average value of the supply bias and the average value of the retrieving bias. Thus, it is possible to perform operations of supplying the toner T to the toner holding surface 62*a* and retrieving the toner T from the toner holding surface 62*a*, using a simple mechanism in a preferable manner.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

Aspects of the present invention may be applied to electrophotographic image forming apparatuses such as color laser printers, and monochrome and color copy machines, as well as the single-color laser printer as exemplified in the aforementioned embodiment. Further, the photoconductive body is not limited to the drum-shaped one as exemplified in the aforementioned embodiment. For instance, the photoconductive body may be formed in the shape of a plate or an endless belt. Additionally, light sources (e.g., LEDs, electroluminescence devices, and fluorescent substances) other than the laser scanner as exemplified in the aforementioned embodiment may be employed for exposure. In such cases, the "main scanning direction" may be parallel to a direction in which light emitting elements such as LEDs are aligned.

Furthermore, aspects of the present invention may be applied to image forming apparatuses of methods other than the aforementioned electrophotographic method (e.g., a toner-jet method using no photoconductive body, an ion flow method, and a multi-stylus electrode method).

Referring to FIG. 4, the voltages generated by the power supply circuits VA, VB, VC, and VD may have an arbitrary waveform (e.g., a sinusoidal waveform and a triangle waveform) other than the rectangle waveform as exemplified in the aforementioned embodiment. Further, in the aforementioned embodiment, the power supply circuits VA, VB, VC, and VD are provided to generate the respective alternating-current driving voltages with a phase difference of 90 degrees between any adjacent two of the power supply circuits VA, VB, VC, and VD in the aforementioned order. However, three power supply circuits may be provided to generate respective alternating-current driving voltages with a phase difference of 120 degrees between any two of the three power supply circuits.

The photoconductive drum 3 and the development roller 62 may contact each other. Alternatively, the laser printer 1 may be configured without the development roller 62. In this case, the transfer board 63 may face the photoconductive drum 3 in the proximity position PXP, i.e., in the development position DP.

The transfer board 63 may be configured without the transfer electrode overcoating layer 634. Alternatively, the transfer board 63 may be configured with the transfer electrodes 631 implanted in the transfer electrode supporting film 632. In this case, the transfer board 63 may be configured without the transfer electrode coating layer 633 or the transfer electrode overcoating layer 634.

The transfer board 63 may be supported by a half-cylinder-shaped supporter. The transfer board 63 may be formed with a flat top. In this case, the transfer board 63 may be formed in a trapezoidal shape when viewed in the z-axis direction (i.e., the transfer board 63 may be supported by a supporter that is trapezoidal when viewed in the z-axis direction).

What is claimed is:

1. A development agent supply device configured to supply charged development agent to an intended device, comprising:

a development agent holding member that comprises a development agent holding surface that is formed to be a cylindrical circumferential surface parallel to a predetermined direction and disposed to face the intended device in a development agent supply position, the development agent holding member being configured to rotate around an axis parallel to the predetermined direction such that the development agent holding surface moves in a direction perpendicular to the predetermined direction;

a transfer board that comprises:

a development agent transfer surface configured to face the development agent holding surface in a proximity position where the development agent transfer surface is in closest proximity to the development agent holding surface, the transfer board being configured to transfer development agent on the development agent transfer surface in a development agent transfer direction perpendicular to the predetermined direction;

a supply section disposed upstream relative to the proximity position in the development agent transfer direction; and a retrieving section disposed downstream relative to the proximity position in the development agent transfer direction, wherein the supply section comprises a plurality of first transfer electrodes arranged along the development agent transfer direction, the supply section being configured to transfer the development agent toward the proximity position in the development agent transfer direction on the development agent transfer surface and supply the development agent to the development agent holding surface near the proximity position, with an electric field generated when a supply bias is applied to the first transfer electrodes, the supply bias containing a first direct-current voltage component and a first traveling-wave multiple-phase alternating-current voltage component, wherein the retrieving section comprises a plurality of second transfer electrodes arranged along the development agent transfer direction, the retrieving section being configured to retrieve development agent from the development agent holding surface near the proximity position and transfer the development agent downstream in the development agent transfer direction on the development agent transfer surface, with an electric field generated when a retrieving bias is applied to the second transfer electrodes, the retrieving bias containing a second direct-current voltage component different from the first direct-current voltage component, the second direct-current voltage component of the retrieving bias being lower than the first direct-current voltage component of the supply bias, and a second traveling-wave multiple-phase alternating-current voltage component, and wherein the supply section has an upstream end configured to be immersed in development agent and a downstream end configured not to be immersed in development agent, while the retrieving section has an upstream end configured not to be immersed in development agent and a downstream end configured to be immersed in development agent;

a supply bias applying unit configured to apply the supply bias only to the first transfer electrodes;

a retrieving bias applying unit configured to apply the retrieving bias only to the second transfer electrodes, the retrieving bias containing the second traveling-wave multiple-phase alternating-current voltage component which has an amplitude identical to an amplitude of the first traveling-wave multiple-phase alternating-current voltage component; and a development bias applying unit configured to apply, to the development agent holding member, a development bias containing a third direct-current voltage component lower than the first direct-current voltage component of the supply bias and higher than the second direct-current voltage component of the retrieving bias, and configured to set an average electric potential of the development agent holding surface to a value between an average value of the supply bias and an average value of the retrieving bias.

2. The development agent supply device according to claim 1, wherein the development agent holding surface is configured to move in a direction that is opposite to the development agent transfer direction in the proximity position.

3. A development agent supply device configured to supply charged development agent to a development agent holding surface that moves in a direction perpendicular to a predetermined direction, the development agent supplying device comprising:

a transfer board that comprises:

a development agent transfer surface configured to face the development agent holding surface in a proximity position where the development agent transfer surface is in closest proximity to the development agent holding surface, the transfer board being configured to transfer development agent on the development agent transfer surface in a development agent transfer direction perpendicular to the predetermined direction;

a supply section disposed upstream relative to the proximity position in the development agent transfer direction; and a retrieving section disposed downstream relative to the proximity position in the development agent transfer direction, wherein the supply section comprises a plurality of first transfer electrodes arranged along the development agent transfer direction, the supply section being configured to transfer the development agent toward the proximity position in the development agent transfer direction on the development agent transfer surface and supply the development agent to the development agent holding surface near the proximity position, with an electric field generated when a supply bias is applied to the first transfer electrodes, the supply bias containing a first direct-current voltage component and a first traveling-wave multiple-phase alternating-current voltage component, wherein the retrieving section comprises a plurality of second transfer electrodes arranged along the development agent transfer direction, the retrieving section being configured to retrieve development agent from the development agent holding surface near the proximity position and transfer the development agent downstream in the development agent transfer direction on the development agent transfer surface, with an electric field generated when a retrieving bias is applied to the second transfer electrodes, the retrieving bias containing a second direct-current voltage component different from the first direct-current voltage component, the second direct-current voltage component of the retrieving bias being lower than the first direct-current voltage component of the supply bias, and a second traveling-wave multiple-phase alternating-current voltage component, and wherein the supply section has an upstream end configured to be immersed in development agent and a downstream end configured not to be immersed in development agent, while the retrieving section has an upstream end configured not to be immersed in development agent and a downstream end configured to be immersed in development agent;

a supply bias applying unit configured to apply the supply bias only to the first transfer electrodes;

a retrieving bias applying unit configured to apply the retrieving bias only to the second transfer electrodes, the retrieving bias containing the second traveling-wave multiple-phase alternating-current voltage component which has an amplitude identical to an amplitude of the first traveling-wave multiple-phase alternating-current voltage component; and a development bias applying unit configured to apply, to the development agent holding member, a development bias containing a third direct-current voltage component lower than the first direct-current voltage component of the supply bias and higher than the second direct-current voltage component of the retrieving bias, and configured to set an average electric potential of the development agent holding surface to a value between an average value of the supply bias and an average value of the retrieving bias.

4. The development agent supply device according to claim 3, wherein the transfer board is further configured such that the development agent holding surface moves in a direction opposite to the development agent transfer direction in the proximity position on the development agent transfer surface.

5. An image forming apparatus comprising:

a photoconductive body configured such that a development agent image is formed thereon;

a development agent supply device configured to supply charged development agent to the photoconductive body, wherein the development agent supply device comprises:

a development agent holding member that comprises a development agent holding surface that is formed to be a cylindrical circumferential surface parallel to a predetermined direction and disposed to face the photoconductive drum in a development agent supply position, the development agent holding member being configured to rotate around an axis parallel to the predetermined direction such that the development agent holding surface moves in a direction perpendicular to the predetermined direction; and a transfer board that comprises:

a development agent transfer surface configured to face the development agent holding surface in a proximity position where the development agent transfer surface is in closest proximity to the development agent holding surface, the transfer board being configured to transfer development agent on the development agent transfer surface in a development agent transfer direction perpendicular to the predetermined direction;

a supply section disposed upstream relative to the proximity position in the development agent transfer direction; and a retrieving section disposed downstream relative to the proximity position in the development agent transfer direction, wherein the supply section comprises a plurality of first transfer electrodes arranged along the development agent transfer direction, the supply section being configured to transfer the development agent toward the proximity position in the development agent transfer direction on the development agent transfer surface and supply the development agent to the development agent holding surface near the proximity position, with an electric field generated when a supply bias is applied to the first transfer electrodes, the supply bias containing a first direct-current voltage component and a first traveling-wave multiple-phase alternating-current voltage component, wherein the retrieving section comprises a plurality of second transfer electrodes arranged along the development agent transfer direction, the retrieving section being configured to retrieve development agent from the development agent holding surface near the proximity position and transfer the development agent downstream in the development agent transfer direction on the development agent transfer surface, with an electric field generated when a retrieving bias is applied to the second transfer electrodes, the retrieving bias containing a second direct-current voltage component different from the first direct-current voltage component, the second direct-current voltage component of the retrieving bias being lower than the first direct-current voltage component of the supply bias, and a second traveling-wave multiple-phase alternating-current voltage component, and wherein the supply section has an upstream end configured to be immersed in development agent and a downstream end configured not to be immersed in development agent, while the retrieving section has an upstream end configured not to be immersed in development agent and a downstream end configured to be immersed in development agent;

a supply bias applying unit configured to apply the supply bias only to the first transfer electrodes;

a retrieving bias applying unit configured to apply the retrieving bias only to the second transfer electrodes, the retrieving bias containing the second traveling-wave multiple-phase alternating-current voltage component which has an amplitude identical to an amplitude of the first traveling-wave multiple-phase alternating-current voltage component; and a development bias applying unit configured to apply, to the development agent holding member, a development bias containing a third direct-current voltage component lower than the first direct-current voltage component of the supply bias and higher than the second direct-current voltage component of the retrieving bias, and configured to set an average electric potential of the development agent holding surface to a value between an average value of the supply bias and an average value of the retrieving bias.

6. The image forming apparatus according to claim 5, wherein the development agent holding surface is configured to move in a direction that is opposite to the development agent transfer direction in the proximity direction.

* * * * *